US008221948B2

(12) United States Patent
Zhou et al.

(10) Patent No.: US 8,221,948 B2
(45) **Date of Patent: *Jul. 17, 2012**

(54) TONER COMPOSITIONS AND PROCESSES

(75) Inventors: Ke Zhou, Oakville (CA); Richard P. N. Veregin, Mississauga (CA); Gwynne McAneney-Lannen, Waterdown (CA); Edward G. Zwartz, Mississauga (CA); Maria N. V. McDougall, Oakville (CA); Guerino Sacripante, Oakville (CA); Karen A. Moffat, Brantford (CA)

(73) Assignee: Xerox Corporation, Norwalt, CT (US)

( * ) Notice: Subject to any disclaimer, the term of this patent is extended or adjusted under 35 U.S.C. 154(b) by 833 days.

This patent is subject to a terminal disclaimer.

(21) Appl. No.: 12/366,940

(22) Filed: Feb. 6, 2009

(65) Prior Publication Data

US 2010/0203439 A1 Aug. 12, 2010

(51) Int. Cl.
*G03G 9/00* (2006.01)

(52) U.S. Cl. ..... 430/109.4; 430/110.2; 430/137.14

(58) Field of Classification Search ..... 430/109.4, 430/137.14, 110.2

See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,959,066 | A | 9/1999 | Charbonneau et al. |
| 5,977,210 | A | 11/1999 | Patel et al. |
| 5,994,020 | A | 11/1999 | Patel et al. |
| 6,025,061 | A | 2/2000 | Khanarian et al. |
| 6,063,464 | A | 5/2000 | Charbonneau et al. |
| 6,063,827 | A | 5/2000 | Sacripante et al. |
| 6,107,447 | A | 8/2000 | Kreuder et al. |
| 6,120,967 | A | 9/2000 | Hopper et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 2006/0222991 | A1 | 10/2006 | Sacripante et al. |
| 2007/0015075 | A1 | 1/2007 | Vijayendran et al. |
| 2008/0090163 | A1 | 4/2008 | Agur et al. |
| 2008/0107989 | A1 | 5/2008 | Sacripante et al. |
| 2008/0145775 | A1 | 6/2008 | Vijayendran et al. |
| 2008/0153027 | A1 | 6/2008 | Veregin et al. |

OTHER PUBLICATIONS

U.S. Appl. No. 12/255,405 filed Oct. 21, 2008 entitled "Toner Compositions and Processes".

*Primary Examiner* — Mark A Chapman
(74) *Attorney, Agent, or Firm* — Eugene O. Palazzo

(57) ABSTRACT

Environmentally friendly toner particles are provided which may, in embodiments, include a bio-based amorphous polyester resin, optionally in combination with another amorphous resin and/or a crystalline resin. Toner particles may, in embodiments, have a core-shell configuration, with the shell formed of the bio-based amorphous polyester resin, the amorphous polyester resin, the crystalline polyester resin, or combinations thereof.

19 Claims, No Drawings

TONER COMPOSITIONS AND PROCESSES

CROSS REFERENCE TO RELATED APPLICATIONS

The present application relates to co-pending U.S. patent application Ser. No. 12/255,405 filed Oct. 21, 2008, entitled Toner Compositions and Processes, the disclosure of which is hereby incorporated by reference in its entirety.

TECHNICAL FIELD

The present disclosure relates to toner compositions and toner processes, such as emulsion aggregation processes and toner compositions formed by such processes. More specifically, the present disclosure relates to emulsion aggregation processes utilizing a bio-based polyester resin. Bio-based products, as used herein, in embodiments, include commercial and/or industrial products (other than food or feed) that may be composed, in whole or in significant part, of biological products or renewable domestic agricultural materials (including plant, animal, or marine materials) and/or forestry materials as defined by the U.S. Office of the Federal Environmental Executive.

BACKGROUND

Numerous processes are within the purview of those skilled in the art for the preparation of toners. Emulsion aggregation (EA) is one such method. Emulsion aggregation toners may be used in forming print and/or xerographic images. Emulsion aggregation techniques may involve the formation of an emulsion latex of the resin particles, by heating the resin, using an emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,763,133, 5,766,818, 5,747,215, 5,804,349, 5,827,633, 5,840,462, 5,853,944, 5,869,215, 5,863,698; 5,902,710; 5,910,387; 5,916,725; 5,919,595; 5,925,488, 5,977,210, 5,994,020, and U.S. Patent Application Publication No. 2008/01017989, the disclosures of each of which are hereby incorporated by reference in their entirety.

Polyester EA ultra low melt (ULM) toners have been prepared utilizing amorphous and crystalline polyester resins as illustrated, for example, in U.S. Patent Application Publication No. 2008/0153027, the disclosure of which is hereby incorporated by reference in its entirety.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. No. 5,916,725, and U.S. Patent Application Publication Nos. 2008/0090163 and 2008/0107989, the disclosures of each of which are hereby incorporated by reference in their entirety. Another example, as disclosed in co-pending U.S. patent application Ser. No. 11/956,878, includes a toner having particles of a bio-based resin, such as, for example, a semi-crystalline biodegradable polyester resin including polyhydroxyalkanoates, wherein the toner is prepared by an emulsion aggregation process.

The vast majority of polymeric materials are based upon the extraction and processing of fossil fuels, leading ultimately to increases in greenhouse gases and accumulation of non-degradable materials in the environment. Furthermore, some current polyester based toners are derived from bisphenol A, which is a known carcinogen/endocrine disruptor. It is highly likely that greater public restrictions on the use of this chemical will be enacted in the future. Thus, alternative, cost-effective, environmentally friendly, polyesters remain desirable.

SUMMARY

The present disclosure provides toner compositions. In embodiments, a toner of the present disclosure can include at least one bio-based amorphous polyester resin, at least one amorphous polyester resin, optionally at least one crystalline polyester resin, and optionally, one or more ingredients such as colorants, waxes, coagulants, and combinations thereof.

In other embodiments, a toner of the present disclosure can include at least one bio-based amorphous polyester resin derived from a fatty dimer diol, a fatty dimer diacid, D-isosorbide, L-tyrosine, glutamic acid, and combinations thereof, at least one amorphous polyester resin, at least one crystalline polyester resin and optionally, one or more ingredients such as colorants, waxes, coagulants, and combinations thereof.

Methods for the present disclosure are also provided. In embodiments, methods of the present disclosure may include contacting at least one bio-based amorphous polyester resin, an optional amorphous polyester resin, and an optional crystalline polyester resin in an emulsion, contacting the emulsion with an optional colorant dispersion, an optional wax, and an optional coagulant to form a mixture, aggregating small particles in the mixture to form a plurality of larger aggregates, contacting the larger aggregates with a shell resin to form a shell over the larger aggregates, coalescing the larger aggregates possessing the shell to form toner particles, and recovering the particles.

DETAILED DESCRIPTION

The present disclosure provides toner processes for the preparation of toner compositions, as well as toners produced by these processes. In embodiments, toners may be produced by a chemical process, such as emulsion aggregation, wherein a mixture of amorphous, crystalline, and bio-based latex resins are aggregated, optionally with a wax and a colorant, in the presence of a coagulant, and thereafter stabilizing the aggregates and coalescing or fusing the aggregates such as by heating the mixture above the glass transition temperature (Tg) of the resin to provide toner size particles.

In embodiments, an unsaturated polyester resin may be utilized as a latex resin. The latex resin may be either crystalline, amorphous, or a mixture thereof. Thus, for example, the toner particles can include a crystalline latex polymer, a semi-crystalline latex polymer, an amorphous latex polymer, or a mixture of two or more latex polymers, where one or more latex polymer is crystalline and one or more latex polymer is amorphous. In embodiments, toner particles of the present disclosure may possess a core-shell configuration.

Core Resins

Any resin may be utilized in forming a toner core of the present disclosure. In the event that the core resin is to be crosslinked, any crosslinkable resin may be utilized. Such resins, in turn, may be made of any suitable monomer. Suitable monomers useful in forming the resin include, but are not limited to, styrenes, acrylates, methacrylates, butadienes, isoprenes, acrylic acids, methacrylic acids, acrylonitriles, diols, diacids, diamines, diesters, mixtures thereof, and the like. Any monomer employed may be selected depending upon the particular polymer to be utilized.

In embodiments, the core resins may be an amorphous resin, a crystalline resin, and/or a combination thereof. In further embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin may have a number average molecular weight ($M_n$), as measured by gel permeation chromatography (GPC) of, for example, from about 1,000 to about 50,000, in embodiments from about 2,000 to about 25,000 (although number average molecular weights outside of these ranges can be obtained), and a weight average molecular weight ($M_w$) of, for example, from about 2,000 to about 100,000, in embodiments from about 3,000 to about 80,000 (although weight average molecular weights outside of these ranges can be obtained), as determined by Gel Permeation Chromatography using polystyrene standards. The molecular weight distribution ($M_w/M_n$) of the crystalline resin may be, for example, from about 2 to about 6, in embodiments from about 3 to about 4 (although molecular weight distributions outside of these ranges can be obtained).

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin (although amounts outside of these ranges can be used).

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin (although amounts outside of these ranges can be used).

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof Such catalysts may be utilized in amounts of, for example, from about 0.01 mole percent to about 5 mole percent based on the starting diacid or diester used to generate the polyester resin (although amounts outside of this range can be used).

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

Examples of other suitable resins or polymers which may be utilized in the core include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In embodiments, the core resin may be a crosslinkable resin. A crosslinkable resin is a resin including a crosslinkable group or groups such as a C═C bond. The resin can be crosslinked, for example, through a free radical polymerization with an initiator.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

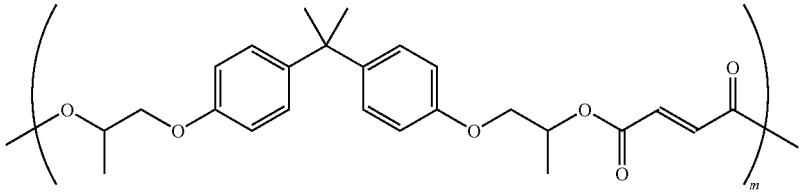

(I)

wherein m may be from about 5 to about 1000, although the value of m can be outside of this range. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina, and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

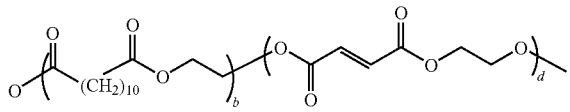

wherein b is from about 5 to about 2000 and d is from about 5 to about 2000, although the values of b and d can be outside of these ranges.

For example, in embodiments, a poly(propoxylated bisphenol A co-fumarate) resin of formula I as described above may be combined with a crystalline resin of formula II to form a core.

In embodiments, core resins utilized in accordance with the present disclosure may also include bio-based amorphous resins. As used herein, a bio-based resin is a resin or resin formulation derived from a biological source such as vegetable oil instead of petrochemicals. As renewable polymers with low environmental impact, their principal advantages are that they reduce reliance on finite resources of petrochemicals; they sequester carbon from the atmosphere. A bio-resin includes, in embodiments, for example, a resin wherein at least a portion of the resin is derived from a natural biological material, such as animal, plant, combinations thereof, and the like. In embodiments, at least a portion of the resin may be derived from materials such as natural triglyceride vegetable oils (e.g. rapeseed oil, soybean oil, sunflower oil) or phenolic plant oils such as cashew nut shell liquid (CNSL), combinations thereof, and the like. Suitable bio-based amorphous resins include polyesters, polyamides, polyimides, polyisobutyrates, and polyolefins, combinations thereof, and the like. In some embodiments, the bio-based resins are also biodegradable.

Examples of amorphous bio-based polymeric resins which may be utilized include polyesters derived from monomers including a fatty dimer acid or diol of soya oil, D-isosorbide, and/or amino acids such as L-tyrosine and glutamic acid as described in U.S. Pat. Nos. 5,959,066, 6,025,061, 6,063,464, and 6,107,447, and U.S. Patent Application Publication Nos. 2008/0145775 and 2007/0015075, the disclosures of each of which are hereby incorporated by reference in their entirety. Combinations of the foregoing may be utilized, in embodiments. Suitable amorphous bio-based resins include those commercially available from Advanced Image Resources, under the trade name BIOREZ™ 13062 and BIOREZ™ 15062. In embodiments, a suitable amorphous bio-based polymeric resin which may be utilized may include a dimer acid of soya oil, isosorbide (which may be obtained from corn starch), with the remainder of the amorphous bio-based polymeric resin being dimethyl terephthalate (DMT).

In embodiments, a suitable amorphous bio-based resin may have a glass transition temperature of from about 45° C. to about 70° C., in embodiments from about 50° C. to about 65° C., a weight average molecular weight (Mw) of from about 2,000 to about 200,000, in embodiments of from about 5,000 to about 100,000, a number average molecular weight (Mn) as measured by gel permeation chromatography (GPC) of from about 1,000 to about 10,000, in embodiments from about 2,000 to about 8,000, a molecular weight distribution (Mw/Mn) of from about 2 to about 20, in embodiments from about 3 to about 15, and a viscosity at about 130° C. of from about 10 Pa*S to about 100000 Pa*S, in embodiments from about 50 Pa*S to about 10000 Pa*S.

The amorphous bio-based resin may be present, for example, in amounts of from about 1 to about 95 percent by weight of the toner components, in embodiments from about 5 to about 50 percent by weight of the toner components, although the amount of the amorphous bio-based resin can be outside of these ranges.

In embodiments, the amorphous bio-based polyester resin may have a particle size of from about 50 nm to about 250 nm in diameter, in embodiments from about 75 nm to 225 nm in diameter, although the particle size can be outside of these ranges.

In embodiments, suitable latex resin particles may include one or more of the amorphous and crystalline resins described above, and one or more amorphous bio-based resins, such as a BIOREZ™ resin described herein.

In embodiments, the amorphous bio-based resin or combination of resins utilized in the core may have a glass transition temperature of from about 40° C. to about 75° C., in embodiments from about 45° C. to about 60° C. (although glass transition temperatures outside of these ranges can be obtained).

In embodiments, the combined resins utilized in the core, including the amorphous bio-based resin, may have a melt viscosity of from about 10 to about 1,000,000 Pa*S at about 140° C., in embodiments from about 50 to about 100,000 Pa*S (although melt viscosities outside of these ranges can be obtained).

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 4% (first resin)/96% (second resin) to about 96% (first resin)/4% (second resin), although weight ratios outside these ranges may be utilized. Where the core resin includes an amorphous resin, a crystalline resin, and a bio-based amorphous resin, the weight ratio of the three resins may be from about 97% (amorphous resin): 2% (crystalline resin): 1% (bio-based amorphous resin), to about 92% (amorphous resin): 4% (crystalline resin): 4% (bio-based amorphous resin), although weight ratios outside of these ranges may be utilized.

In embodiments, the resin may be formed by condensation polymerization methods. In other embodiments, the resin may be formed by emulsion polymerization methods.

Toner

The resins described above may be utilized to form toner compositions. Such toner compositions may include optional colorants, waxes, coagulants and other additives, such as surfactants. Toners may be formed utilizing any method within the purview of those skilled in the art. The toner particles may also include other conventional optional additives, such as colloidal silica (as a flow agent).

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the use of anionic and nonionic surfactants help stabilize the aggregation process in the presence of the coagulant, which otherwise could lead to aggregation instability.

In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition, although the amount of surfactant can be outside of these ranges.

Examples of nonionic surfactants that can be utilized include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ (alkyl phenol ethoxylate). Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. An example of a suitable cationic surfactant may be SANIZOL B-50 available from Kao Corp., which consists primarily of benzyl dimethyl alkonium chloride.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although the amount of colorant can be outside of these ranges.

As examples of suitable colorants, mention may be made of carbon black like REGAL 330™ (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1 weight percent to about 35 weight percent of the toner particles on a solids basis, in other embodiments, from about 5 weight percent to about 25 weight percent. However, in embodiments, amounts outside these ranges can also be used.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles, although the amount of wax can be outside of these ranges.

When a wax dispersion is used, the wax dispersion may include any of the various waxes conventionally used in emulsion aggregation toner compositions. Waxes that may be selected include waxes having, for example, a weight average molecular weight of from about 500 to about 20,000, in embodiments from about 1,000 to about 10,000, although waxes having weights outside these ranges may be utilized. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be from about 100 nm to about 300 nm, although sizes outside these ranges may be utilized.

Coagulants

Optionally, a coagulant may also be combined with the resin, a colorant and a wax in forming toner particles. Such coagulants may be incorporated into the toner particles during particle aggregation. The coagulant may be present in the toner particles, exclusive of external additives and on a dry weight basis, in an amount of, for example, from about 0 weight percent to about 5 weight percent of the toner particles, in embodiments from about 0.01 weight percent to about 3 weight percent of the toner particles, although the amount of coagulant can be outside of these ranges.

Coagulants that may be used include, for example, an ionic coagulant, such as a cationic coagulant. Inorganic cationic coagulants include metal salts, for example, aluminum sulfate, magnesium sulfate, zinc sulfate, potassium aluminum sulfate, calcium acetate, calcium chloride, calcium nitrate, zinc acetate, zinc nitrate, aluminum chloride, combinations thereof, and the like.

Examples of organic cationic coagulants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, combinations thereof, and the like.

Other suitable coagulants include, a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, in embodiments at least 4 or 5. Suitable coagulants thus include, for example, coagulants based on aluminum salts, such as aluminum sulfate and aluminum chlorides, polyaluminum halides such as polyaluminum fluoride and polyaluminum chloride (PAC), polyaluminum silicates such as polyaluminum sulfosilicate (PASS), polyaluminum hydroxide, polyaluminum phosphate, combinations thereof, and the like.

Other suitable coagulants also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, combinations thereof, and the like. Where the coagulant is a polyion coagulant, the coagulants may have any desired number of polyion atoms present. For example, in embodiments, suitable polyaluminum compounds may have from about 2 to about 13, in other embodiments, from about 3 to about 8, aluminum ions present in the compound.

Toner Preparation

The toner particles may be prepared by any method within the purview of those skilled in the art. Although embodiments relating to toner particle production are described below with respect to emulsion-aggregation processes, any suitable method of preparing toner particles may be used, including chemical processes, such as suspension and encapsulation processes disclosed in, for example, U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by an emulsion aggregation process that includes aggregating a mixture of an optional colorant, an optional wax, a coagulant, and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin(s). For example, emulsion/aggregation/coalescing processes for the preparation of toners are illustrated in the disclosure of the patents and publications referenced hereinabove.

The pH of the resulting mixture may be adjusted by an acid such as, for example, acetic acid, sulfuric acid, hydrochloric acid, citric acid, trifluro acetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 weight percent by weight of water, in other embodiments, of from about 0.7 to about 5 weight percent by weight of water.

Examples of bases used to increase the pH and ionize the aggregate particles, thereby providing stability and preventing the aggregates from growing in size, can include sodium hydroxide, potassium hydroxide, ammonium hydroxide, cesium hydroxide and the like, among others.

Additionally, in embodiments, the mixture may be homogenized. If the mixture is homogenized, homogenization may be accomplished by mixing at a speed of from about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture, although the amount of aggregating agent can be outside of these ranges.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example, with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, an emulsion aggregation process involves the formation of an emulsion latex of the resin particles, such as one or more of the polyhydroxyalkanoates resins described herein and resin particles of one or more of the amorphous bio-based resins described herein. The toner particles, in combination with additional ingredients used in emulsion aggregation toners (for example, one or more colorants, coagulants, additional resins, and/or waxes) may be heated to enable coalescence/fusing, thereby achieving aggregated, fused toner particles. In an embodiment, the emulsion aggregation process is carried out without the use of an organic solvent to obtain the desired particle size of the resin.

Shell Resin

In embodiments, after aggregation, but prior to coalescence, a resin coating may be applied to the aggregated particles to form a shell thereover. Any resin described above as suitable for forming the core resin may be utilized as the shell.

In embodiments, resins which may be utilized to form a shell include, but are not limited to, crystalline polyesters described above, and/or the amorphous resins described above for use as the core. In embodiments, a bio-based resin latex as described above may be included in the shell. In yet other embodiments, the bio-based resin described above may be combined with another resin and then added to the particles as a resin coating to form a shell. For example, in embodiments, an amorphous resin of Formula 1 above may be combined with a crystalline resin of Formula II above and an amorphous bio-based resin to form a shell. Multiple resins may be utilized in any suitable amounts. In embodiments, a first amorphous bio-based polyester resin, for example BIOREZ™, may be present in an amount of from about 20 percent by weight to about 100 percent by weight of the shell resin, in embodiments from about 30 percent by weight to about 90 percent by weight of the shell resin, although amounts outside of these ranges may be utilized. Thus, in embodiments, a second and/or third resin may be present in the shell resin in an amount of from about 0 percent by weight to about 80 percent by weight of the shell resin, in embodiments from about 10 percent by weight to about 70 percent by weight of the shell resin, although the amounts of the second resin can be outside of these ranges.

The shell resin may be applied to the aggregated particles by any method within the purview of those skilled in the art. In embodiments, the resins utilized to form the shell may be in an emulsion including any surfactant described above. The emulsion possessing the resins, may be combined with the aggregated particles described above so that the shell forms over the aggregated particles. In embodiments, the shell may have a thickness of up to about 5 microns, in embodiments, of from about 0.1 to about 2 microns, in other embodiments, from about 0.3 to about 0.8 microns, over the formed aggregates, although thicknesses outside of these ranges may be obtained.

The formation of the shell over the aggregated particles may occur while heating to a temperature of from about 30° C. to about 80° C., in embodiments from about 35° C. to about 70° C., although temperatures outside of these ranges may be utilized. The formation of the shell may take place for a period of time of from about 5 minutes to about 10 hours, in embodiments from about 10 minutes to about 5 hours, although times outside of these ranges may be used.

For example, in some embodiments, the toner process may include forming a toner particle by mixing the polymer latexes, in the presence of a wax and a colorant dispersion, with an optional coagulant while blending at high speeds. The resulting mixture having a pH of, for example, of from about 2 to about 3, is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution, until a pH of about 7 is achieved.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C. (although temperatures outside of these ranges may be used), which may be at or above the glass transition temperature of the resins utilized to form the toner particles, and/or reducing the stirring, for example to from about 100 rpm to about 1,000 rpm, in embodiments from about 200 rpm to about 800 rpm (although speeds outside of these ranges may be used). The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from about 0.01 to about 9 hours, in embodiments from about 0.1 to about 4 hours (although times outside of these ranges may be used).

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner (although amounts outside of these ranges may be used). Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner, although the amount of additives can be outside of these ranges. In embodiments, the toners may include, for example, from about 0.1 weight percent to about 5 weight percent titania, from about 0.1 weight percent to about 8 weight percent silica, and from about 0.1 weight percent to about 4 weight percent zinc stearate (although amounts outside of these ranges may be used).

Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics:

(1) Volume average diameter (also referred to as "volume average particle diameter") was measured for the toner particle volume and diameter differentials. The toner particles have a volume average diameter of from about 3 to about 25 μm, in embodiments from about 4 to about 15 μm, in other embodiments from about 5 to about 12 μm (although values outside of these ranges may be obtained).

(2) Number Average Geometric Size Distribution (GSDn) and/or Volume Average Geometric Size Distribution (GSDv): In embodiments, the toner particles described in (1) above may have a very narrow particle size distribution with a lower number ratio GSD of from about 1.15 to about 1.38, in other embodiments, less than about 1.31 (although values outside of these ranges may be obtained). The toner particles of the present disclosure may also have a size such that the upper GSD by volume in the range of from about 1.20 to about 3.20, in other embodiments, from about 1.26 to about 3.11 (although values outside of these ranges may be obtained). Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(3) Shape factor of from about 105 to about 170, in embodiments, from about 110 to about 160, SF1*a (although values outside of these ranges may be obtained). Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

(4) Circularity of from about 0.92 to about 0.99, in other embodiments, from about 0.94 to about 0.975 (although values outside of these ranges may be obtained). The instrument used to measure particle circularity may be an FPIA-2100 manufactured by Sysmex.

The characteristics of the toner particles may be determined by any suitable technique and apparatus and are not limited to the instruments and techniques indicated hereinabove.

In embodiments, the toner particles may have a weight average molecular weight (Mw) in the range of from about 17,000 to about 60,000 daltons, a number average molecular weight (Mn) of from about 9,000 to about 18,000 daltons, and a MWD (a ratio of the Mw to Mn of the toner particles, a measure of the polydispersity, or width, of the polymer) of from about 2.1 to about 10 (although values outside of these ranges may be obtained). For cyan and yellow toners, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10 (although values outside of these ranges may be obtained). For black and magenta, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10 (although values outside of these ranges may be obtained).

Further, the toners if desired can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder which represents the highest peak of the Mw. In the present disclosure, the binder can have a molecular peak (Mp) in the range of from about 22,000 to about 30,000 daltons, in embodiments, from about 22,500 to about 29,000 daltons (although values outside of these ranges may be obtained). The toner particles prepared from the binder also exhibit a high molecular peak, for example, in embodiments, of from about 23,000 to about 32,000, in other embodiments, from about 23,500 to about 31,500 daltons (although values outside of these ranges may be obtained), indicating that the molecular peak is driven by the properties of the binder rather than another component such as the colorant.

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH (although values outside of these ranges may be obtained). Toners of the present disclosure may possess a parent toner charge per mass ratio (Q/M) of from about −2 μC/g to about −28 μC/g, in embodiments from about −4 μC/g to about −25 μC/g (although values outside of these ranges may be obtained), and a final toner charging after surface additive blending of from −8 μC/g to about −25 μC/g, in embodiments from about −10 μC/g to about −22 μC/g (although values outside of these ranges may be obtained).

Developer

The toner particles may be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer (although values outside of these ranges may be used). In embodiments, the toner concentration may be from about 90% to about 98% by weight of the carrier (although values outside of these ranges may be used). However, different toner and carrier percentages may be used to achieve a developer composition with desired characteristics.

Carriers

Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 weight % to about 70 weight %, in embodiments from about 40 weight % to about 60 weight % (although values outside of these ranges may be used). The coating may have a coating weight of, for example, from about 0.1 weight % to about 5% by weight of the carrier, in embodiments from about 0.5 weight % to about 2% by weight of the carrier (although values outside of these ranges may be obtained).

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles (although values outside of these ranges may be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside of these ranges may be used), coated with about 0.5% to about 10% by weight, in embodiments from about 0.7% to about 5% by weight (although amounts outside of these ranges may be obtained), of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although concentrations outside of this range may be obtained). However, different toner and carrier percentages may be used to achieve a developer composition with desired characteristics.

Imaging

Toners of the present disclosure may be utilized in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside of these ranges may be used), after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Two batches of bio-based resin derived from Soya oil were used in the Examples. BIOREZ™ 15062 and BIOREZ™ 13062 from Advanced Imaging Resource (AIR). These resins are made from Soya bean derived monomers, such as dimer acids. A summary of some of the properties of these resins is set forth below in Table 1.

TABLE 1

| Resin | Mw | Tg | Mn | Mw/Mn (PD) | Viscosity @ 130 C. |
|---|---|---|---|---|---|
| Amorphous resin utilized in Examples | 12,500 | 56.9 | 4.4 | 2.82 | 117.13 Pa · S |
| BIOREZ ™ 13062 | 17,200 | 53.25 | 4.5 | 3.79 | 2306.52 Pa · S |
| BIOREZ ™ 15062 | 75,100 | 56.89 | 5.4 | 13.88 | 7123.49 Pa · S |

Comparative Example 1

This Comparative Example included no bio-based resin (derived from soya oil) in the toner as a control. About 397.99 grams of a linear amorphous resin in an emulsion (about 17.03 weight % resin) was added to a 2 liter beaker. The linear amorphous resin was of the following formula:

(I)

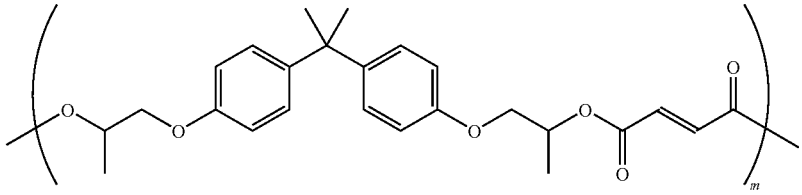

wherein m was from about 5 to about 1000 and was produced following the procedures described in U.S. Pat. No. 6,063,827, the disclosure of which is hereby incorporated by reference in its entirety.

About 74.27 grams of an unsaturated crystalline polyester ("UCPE") resin including ethylene glycol and a mixture of dodecanedioic acid and fumaric acid co-monomers of the following formula:

(II)

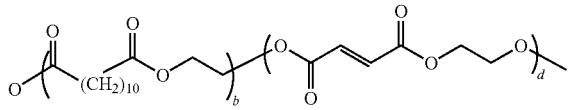

wherein b was from 5 to 2000 and d was from 5 to 2000 in an emulsion (about 19.98 weight % resin), synthesized following the procedures described in U.S. Patent Application Publication No. 2006/0222991, the disclosure of which is hereby incorporated by reference in its entirety, about 29.24 grams of a cyan pigment, Pigment Blue 15:3, (about 17 weight %), and about 281.8 grams of deionized water were added to the beaker. About 36 grams of $Al_2(SO_4)_3$ (about 1 weight %) was added as a flocculent under homogenization by mixing the mixture at about 3000 to 4000 rpm.

The mixture was subsequently transferred to a 2 liter Buchi reactor, and heated to about 45.9° C. for aggregation and mixed at a speed of about 750 rpm. The particle size was monitored with a Coulter Counter until the size of the particles reached an average volume particle size of about 6.83 μm with a Geometric Size Distribution ("GSD") of about 1.21. About 198.29 grams of the above emulsion with the resin of formula I was then added to the particles to form a shell thereover, resulting in particles possessing a core/shell structure with an average particle size of about 8.33 μm, and a GSD of about 1.21.

Thereafter, the pH of the reaction slurry was increased to about 6.7 by adding NaOH followed by the addition of about 0.45 pph EDTA (based on dry toner) to freeze, that is stop, the toner growth. After stopping the toner growth, the reaction mixture was heated to about 69° C. and kept at that temperature for about 1 hour for coalescence.

The resulting toner particles had a final average volume particle size of about 8.07, a GSD of about 1.22, and a circularity of about 0.976.

The toner slurry was then cooled to room temperature, separated by sieving (utilizing a 25 μm sieve) and filtered, followed by washing and freeze drying.

Example 1

A toner was prepared having about 10% of a low molecular weight resin made from soya bean derived monomers in the toner core.

About 125 grams of BIOREZ™ 13062 resin was measured into a 2 liter beaker containing about 917 grams of ethyl acetate. The mixture was stirred at about 300 revolutions per minute at room temperature to dissolve the resin in the ethyl acetate. About 5.64 grams of sodium bicarbonate was measured into a 4 liter Pyrex glass flask reactor containing about 708 grams of deionized water. Homogenization of the water solution in the 4 liter glass flask reactor occurred with an IKA Ultra Turrax T50 homogenizer operating at about 4,000 revolutions per minute. The resin solution was then slowly poured into the water solution as the mixture continued to be homogenized, with the homogenizer speed increased to about 8,000 revolutions per minute. Homogenization was carried out at these conditions for about 30 minutes. Upon completion of homogenization, the glass flask reactor and its contents were placed in a heating mantle and connected to a distillation device. The mixture was stirred at about 275 revolutions per minute and the temperature of the mixture was increased to about 80° C. at a rate of about 1° C. per minute to distill off the ethyl acetate from the mixture. Stirring of the mixture continued at about 80° C. for about 120 minutes followed by cooling at about 2° C. per minute to room temperature.

The product was screened through a 20 micron sieve. The resulting resin emulsion included about 16.93 per cent by weight solids in water, having a volume average diameter of about 151 nanometers as measured with a HONEYWELL MICROTRAC® UPA150 particle size analyzer.

The following were combined in a 2 liter beaker: about 360.76 grams of the linear amorphous resin of Formula I above in an emulsion (about 16.73 wt %), about 80.12 grams of the UCPE resin of Formula II above in an emulsion (about 19.47 wt %), about 76.81 grams of the BIOREZ™ 13062 emulsion described above (about 16.93 wt %), about 36.88 grams of Pigment Blue 15:3 (about 14.6 wt %), and about 293 grams of deionized water. About 38.83 grams of $Al_2(SO_4)_3$ (about 1 wt %) was added in as flocculent under homogenization.

The mixture was subsequently transferred to a 2 liter Buchi, and heated to about 44.5° C. for aggregation at about 700 rpm. The particle size was monitored with a Coulter Counter until the core particles reached a volume average particle size of about 6.97 μm with a GSD of about 1.24. Then, about 218.01 grams of the above linear amorphous resin of Formula I in an emulsion was added to form a shell, resulting in a core-shell structured particle having an average particle size of about 8.59 microns, and a GSD of about 1.21.

Thereafter, the pH of the reaction slurry was increased to about 7.5 using NaOH to freeze the toner growth, followed by the addition of about 1.5 grams of EDTA solution (about 39 wt %). After freezing, the reaction mixture was heated to 69° C. for coalescence.

The toner thus produced had a final particle size of about 8.68 microns, a GSD of about 1.23, and a circularity of 0.946.

The toner slurry was then cooled to room temperature, separated by sieving (25 μm), filtration, followed by washing and freeze dried.

Example 2

A toner was prepared having about 5% of a high molecular weight resin made from soya bean derived monomers in the toner core.

About 125 grams of BIOREZ™ 15062 resin was measured into a 2 liter beaker containing about 917 grams of ethyl acetate. The mixture was stirred at about 300 revolutions per minute at room temperature to dissolve the resin in the ethyl acetate. About 4.29 grams of sodium bicarbonate was measured into a 4 liter Pyrex glass flask reactor containing about 708 grams of deionized water. Homogenization of the water solution in the 4 liter glass flask reactor occurred with an IKA Ultra Turrax T50 homogenizer operating at about 4,000 revolutions per minute. The resin solution was then slowly poured into the water solution as the mixture continued to be homogenized, with the homogenizer speed increased to about 8,000 revolutions per minute. Homogenization was carried out at these conditions for about 30 minutes. Upon completion of homogenization, the glass flask reactor and its contents were placed in a heating mantle and connected to a distillation device. The mixture was stirred at about 275 revolutions per minute and the temperature of the mixture was increased to about 80° C. at a rate of about 1° C. per minute to distill off the ethyl acetate from the mixture. Stirring of the mixture continued at about 80° C. for about 120 minutes followed by cooling at about 2° C. per minute to room temperature. The product was screened through a 20 micron sieve. The resulting resin emulsion included about 16.78 per cent by weight solids in water, and had a volume average diameter of about 222 nanometers as measured with a HONEYWELL MICROTRAC® UPA150 particle size analyzer.

The following were combined in a 2 liter beaker: about 340.93 grams of the linear amorphous resin of Formula I above in an emulsion (about 18.76 wt %); about 42.04 grams of the UCPE resin of Formula II above in an emulsion (about 35.48 wt %); about 37.24 grams of the BIOREZ™ 15062 emulsion produced as described above (about 16.78 wt %); about 35.26 grams of Pigment Blue 15:3 (about 14.6 wt %); and about 355.1 grams of deionized water. About 37.13 grams of $Al_2(SO_4)_3$ (about 1 wt %) was added in as flocculent under homogenization.

The mixture was subsequently transferred to a 2 liter Buchi, and heated to about 43.5° C. for aggregation at about 700 rpm. The particle size was monitored with a Coulter Counter until the core particles reached a volume average particle size of about 6.97 μm with a GSD of about 1.25, and then about 186.45 grams of the above linear amorphous resin of Formula I in an emulsion was added as shell, resulting in core-shell structured particles having an average particle size of about 8.87 microns, and a GSD of about 1.19.

Thereafter, the pH of the reaction slurry was increased to about 7.5 using NaOH to freeze the toner growth, followed by the addition of about 1.434 grams of EDTA in solution (about 39 wt %). After freezing, the reaction mixture was heated to about 71° C. for coalescence. The toner had a final particle size of about 8.96 microns, a GSD of about 1.21, and a circularity of about 0.96.

The toner slurry was then cooled to room temperature, separated by sieving (25 μm), filtration, followed by washing and freeze dried.

Fusing characteristics of the toners produced in Comparative Example 1 and the Examples were determined by crease area, minimum fixing temperature, gloss, document offset, and vinyl offset testing.

Crease Area

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity. From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient. Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

Minimum Fixing Temperature

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss

Print gloss (Gardner gloss units or "ggu") was measured using a 75° BYK Gardner gloss meter for toner images that had been fused at a fuser roll temperature range of about 120° C. to about 210° C. (sample gloss was dependent on the toner, the toner mass per unit area, the paper substrate, the fuser roll, and fuser roll temperature).

Document Offset

A standard document offset mapping procedure was performed as follows. Five centimeter (cm) by five cm test samples were cut from the prints taking care that when the sheets are placed face to face, they provide both toner to toner and toner to paper contact. A sandwich of toner to toner and toner to paper was placed on a clean glass plate. A glass slide was placed on the top of the samples and then a weight comprising a 2000 gram mass was placed on top of the glass slide. The glass plate was then inserted into an environmental chamber at a temperature of 60° C. where the relative humidity was kept constant at 50%. After 7 days, the samples were removed from the chamber and allowed to cool to room temperature before the weight was removed. The removed samples were then carefully peeled apart. The peeled samples were mounted onto a sample sheet and then visually rated with a Document Offset Grade from 5.0 to 1.0, wherein a lower grade indicates progressively more toner offset, ranging from none (5.0) to severe (1.0). Grade 5.0 indicates no toner offset and no adhesion of one sheet to the other. Grade 4.5 indicates noticeable adhesion, but no toner offset. Grade 4 indicates that a very small amount of toner offsets to the other sheet. Grade 3 indicates that less than ⅓ of the toner image offsets to the other sheet, while Grade 1.0 indicates that more than ½ of the toner image offsets to the other sheet. In general, an evaluation of greater than or equal to 3.0 is considered the minimum acceptable offset, and an evaluation of greater than or equal to 4.0 is desirable.

Vinyl Offset

Vinyl offset was evaluated as follows. Toner images were covered with a piece of standard vinyl (32% dioctyl phthalate Plasticizer), placed between glass plates, loaded with a 250 gram weight, and placed in an environmental oven at a pressure of 10 g/cm$^2$, 50° C. and 50% relative humidity (RH). After about 24 hours, the samples were removed from the oven and allowed to cool to room temperature. The vinyl and toner image were carefully peeled apart, and evaluated with reference to a vinyl offset evaluation rating procedure as described above for document offset wherein Grades 5.0 to 1.0 indicate progressively higher amounts of toner offset onto the vinyl, from none (5.0) to severe (1.0). Grade 5.0 indicates no visible toner offset onto the vinyl and no disruption of the image gloss. Grade 4.5 indicates no toner offset, but some disruption of image gloss. An evaluation of greater than or equal to 4.0 is considered an acceptable grade.

The fusing results are summarized in Table 2 below.

TABLE 2

| | Comparative Example 1 | Example 1 10% Low Mw BioRez | Example 2 5% Hi Mw BioRez |
|---|---|---|---|
| CX+ (90 gsm) paper | | | |
| Cold Offset | 113 | 129 | 130 |
| Hot Offset | >210 | >210 | >210 |
| TG40 | 142 | 156 | 146 |
| Gloss @ MFT | 38.0 | 32.2 | 35.1 |
| Gloss ® 185° C. | 72.5 | 54.5 | 66.4 |
| Peak Gloss | 72.6 | 55.2 | 66.7 |
| $MFT_{CA-85}$ | 140 | 148 | 142 |
| $\Delta MFT_{CA-85}$ | −34 | −32 | −27 |
| MFT/ΔMFT | 142/−34 | 156/−25 | 146/−33 |
| $FC_{CA-85}$ | 4.34 + 1.00 (15.1) | 3.66 | 3.37 |
| Document Offset (Toner-Toner) SIR (msLA) | | 2.50 (0.10) | 2.50 (0.1) |
| Document Offset (Toner-Paper) SIR (% toner) | 1.00 (12.5) | 1.25 (2.6) | 1.00 (1.0) |
| Vinyl Offset SIR (% toner) | N/A | N/A | N/A |
| DCEG (120 gsm) paper | | | |
| $T_{G40}$ | 141 | 153 | 146 |
| Gloss @ MFT | 31.5 | 21.7 | 18.5 |
| Gloss @185° C. | 80.2 | 76.8 | 89.2 |
| Peak Gloss | 94.1 | 84.7 | 93.8 |
| $MFT_{CA-85}$ | 137 | 142 | 137 |
| $\Delta MFT_{CA-85}$ | −34 | −31 | −31 |
| MFT/ΔMFT | 141/−40 | 153/−31 | 146/−34 |

As can be seen from Table 2, resins made from soya bean derived monomers in the toner core improved the 24-hour document offset properties in both cases (i.e., toners including a low molecular weight resin made from soya bean derived monomers in the toner core, and toners including a high molecular weight resin made from soya bean derived monomers in the toner core). Severe toner to toner (about 15.1 grams) and toner to paper (about 12.5 grams) damage was visible for the toner of Comparative Example 1, with a SIR=1.00/1.00. The toner of Example 1 toner, having about 10% low molecular weight BIOREZ™ 13062, was ranked SIR=2.5 (toner to toner, about 0.10 grams) and SIR=1.25 (toner to paper, about 2.6 grams). The toner of Example 2, having about 5% high molecular weight BIOREZ™ 15062, was ranked SIR=2.5 (toner to toner, about 0.1 grams) and SIR=1.00 (toner to paper, about 1 gram).

The 24 hour document offset properties are summarized in Table 3 below.

TABLE 3

| | Document Offset (T-T) SIR Ranking | Document Offset (T-T) IQAF (rmsLA) | Document Offset (T-P) SIR Ranking | Document Offset (T-P) IQAF (% Toner) |
|---|---|---|---|---|
| Comparative Example 1 | 1.00 | 15.1 | 1.00 | 12.5 |
| Example 1 | 2.50 | 0.1 | 1.25 | 2.6 |
| Example 2 | 2.50 | 0.1 | 1.00 | 1.0 |

As can be seen from Table 3, the toner of Comparative Example 1 had poor document offset, while toners containing the resin made from soya bean derived monomers in the toner core showed good document offset, especially toner to toner document offset.

The above data thus demonstrates that the document offset was improved remarkably for toners of the present disclosure while retaining excellent fusing properties. Furthermore, the unwanted high peak gloss of the comparative toner was reduced when one of the resins made from soya bean derived monomers was incorporated in the toner core.

Toners produced in accordance with the present disclosure may possess excellent charging characteristics when exposed to extreme relative humidity (RH) conditions. The low-humidity zone (C zone) is about 10° C./15% RH, while the high humidity zone (A zone) is about 28° C./85% RH. A-zone and C-zone charging were measured by a total blow off apparatus also known as a Barbetta box. Developers were conditioned overnight in A zones and C zones and then charged using a paint shaker for from about 5 minutes to about 60 minutes to provide information about developer stability with time and between zones.

The charging results are summarized in Table 4 below.

TABLE 4

| Toner ID | Comparative Example 1 | Example 1 | Example 2 |
|---|---|---|---|
| Comment | Control | 10% low Mw BioRez | 5% Hi Mw BioRez |
| Q/m AZ 5M | −3.7 | −6.1 | −1.55 |
| Q/m AZ 60M | −3.6 | −4.3 | −1.12 |
| Q/m CZ 5M | −16.6 | −29.62 | −12.25 |
| Q/m CZ 60M | −13.7 | −23.46 | −11.4 |

As can be seen from Table 4, the toner of Example 1, containing about 10% of the low molecular weight resin made from soya bean derived monomers in the toner core, had better charging than the toner of Comparative Example 1, while the toner of Example 2, containing about 5% of the high molecular weight resin made from soya bean derived monomers in the toner core, had lower charging than the toner of Comparative Example 1.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner consisting of: at least one bio-based amorphous polyester resin; at least one amorphous polyester resin; optionally at least one crystalline polyester resin; and one or more ingredients selected from the group consisting of colorants, waxes, coagulants, and combinations thereof, and wherein the toner particles comprise a core with a shell thereover.

2. The toner of claim 1, wherein the amorphous bio-based polyester resin is derived from a fatty dimer diol, a fatty dimer diacid, D-isosorbide, L-tyrosine, glutamic acid, and combinations thereof.

3. The toner of claim 1, wherein the bio-based polyester resin is derived at least in part from a material selected from the group consisting of natural triglyceride vegetable oils, phenolic plant oils, and combinations thereof and wherein said at least one is one.

4. The toner of claim 1, wherein the core consists of said crystalline polyester resin and the bio-based amorphous resin, and the shell consists of said amorphous polyester resin.

5. The toner of claim 1, wherein the core consists of the bio-based amorphous resin and the amorphous polyester resin.

6. The toner of claim 1, wherein the core consists of the bio-based amorphous resin, the amorphous polyester resin, and the crystalline resin.

7. The toner of claim 1, wherein the shell has a thickness of from 0.1 to about 5 microns.

8. The toner composition of claim 1, wherein the bio-based amorphous resin is present in an amount of from about 1 percent by weight of the toner components to about 95 percent by weight of the toner components.

9. The toner composition of claim 1, wherein the at least one amorphous polyester resin selected is from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof and wherein at least one is one.

10. The toner composition of claim 1, wherein that at least one crystalline polyester resin is selected from the group consisting of polyethylene-adipate), poly(propylene-adipate), poly(butylene-adipate), poly(pentylene-adipate), poly (hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

11. The toner of claim 1, wherein the coagulant is selected from the group consisting of aluminum salts, polyaluminum halides, polyaluminum silicates, polyaluminum hydroxides, polyaluminum phosphates, and combinations thereof, the wax is selected from the group consisting of a polyethylene wax, a polypropylene wax, and combinations thereof, and is present in an amount of from about 5 percent to about 15 percent by weight of the toner, and said colorant is a pigment, a dye, and combinations thereof, present in an amount of from about 1 percent to about 25 percent by weight of the toner.

12. A toner consisting of: a bio-based amorphous polyester resin derived from a fatty dimer diol, a fatty dimer diacid, D-isosorbide, L-tyrosine, glutamic acid, and combinations thereof; an amorphous polyester resin; a crystalline polyester resin; and a colorant and a wax and wherein said toner consists of a core of said bio-based amorphous polyester resin, said crystalline polyester resin and optionally said amorphous polyester resin and a shell present on said core said shell consisting of said amorphous polyester.

13. The toner of claim 12, wherein said bio-based amorphous polyester resin has a particle size of from about 50 nm to about 250 nm in diameter and is present in the toner in an amount of from about 5 percent by weight of the toner components to about 50 percent by weight of the toner components.

14. The toner composition of claim 12, wherein said amorphous polyester resin is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and wherein said crystalline polyester resin is selected from the group consisting of poly(ethylene-adipate), poly(propylene-adipate), poly(butylene-adipate), poly(pentylene-adipate), poly(hexylene-adipate), poly (octylene-adipate), poly(ethylene-succinate), poly (propylene-succinate), poly(butylene-succinate), poly (pentylene-succinate), poly(hexylene-succinate), poly (octylene-succinate), poly(ethylene-sebacate), poly (propylene-sebacate), poly(butylene-sebacate), poly (pentylene-sebacate), poly(hexylene-sebacate), poly (octylene-sebacate), poly(decylene-sebacate), poly (decylene-decanoate), poly-(ethylene-decanoate), poly-(ethylene-dodecanoate), poly(nonylene-sebacate), poly (nonylene-decanoate), copoly(ethylene-fumarate)-copoly (ethylene-sebacate), copoly(ethylene-fumarate)-copoly(ethylene-decanoate), copoly(ethylene-fumarate)-copoly(ethylene-dodecanoate), and combinations thereof.

15. The toner of claim 12, wherein said shell is of a thickness of from 0.1 to about 5 microns.

16. A process for preparing a toner, comprising: contacting at least one bio-based amorphous polyester resin, an amorphous polyester resin, and a crystalline polyester resin in an emulsion, contacting the emulsion with a colorant dispersion, a wax, and a coagulant to form a mixture; aggregating small particles in the mixture to form a plurality of larger aggregates; contacting the larger aggregates with a shell resin to form a shell over the larger aggregates; coalescing the larger aggregates possessing the shell to form toner particles; and recovering the particles and wherein said shell is selected from the group consisting of the bio-based amorphous polyester resin, the amorphous polyester resin, the crystalline polyester resin, and mixtures thereof, and said bio-based amorphous polyester is derived from a fatty dimer diol, a fatty dimer diacid, D-isosorbide, L-tyrosine, glutamic acid, and combinations thereof, the optional amorphous polyester resin is selected from the group consisting of poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly (butyloxylated bisphenol co-itaconate), poly(co-propoxylated bisphenol co-ethoxylated bisphenol co-itaconate), poly (1,2-propylene itaconate), and combinations thereof, and said crystalline polyester resin is selected from the group consisting of poly(ethylene-adipate), poly(propylene-adipate), poly (butylene-adipate), poly(pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and mixtures thereof.

17. The process of claim 16, wherein the bio-based amorphous polyester resin is derived from a fatty dimer diol, a fatty dimer diacid, or D-isosorbide, and the amorphous polyester resin is selected from the group consisting of poly(propoxylated bisphenol co-fumarate), poly(ethoxylated bisphenol co-fumarate), poly(butyloxylated bisphenol co-fumarate), and poly(co-propoxylated bisphenol co-ethoxylated bisphenol co-fumarate).

18. The process of claim 16, wherein the shell resin is selected from the group consisting of the bio-based amorphous polyester resin, and the amorphous polyester resin.

19. The process of claim 16, wherein the toner particles have a volume average diameter of from about 3 microns to about 25 microns and a circularity of from about 0.92 to about 0.99.

* * * * *